US009895901B2

(12) United States Patent
Saito et al.

(10) Patent No.: US 9,895,901 B2
(45) Date of Patent: Feb. 20, 2018

(54) INK JET RECORDING METHOD AND INK JET RECORDING APPARATUS

(71) Applicant: CANON KABUSHIKI KAISHA, Tokyo (JP)

(72) Inventors: Takashi Saito, Kawasaki (JP); Masashi Tsujimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/278,416

(22) Filed: Sep. 28, 2016

(65) Prior Publication Data

US 2017/0120619 A1 May 4, 2017

(30) Foreign Application Priority Data

Oct. 30, 2015 (JP) ..... 2015-213657

(51) Int. Cl.
*B41J 2/19* (2006.01)
*B41J 2/175* (2006.01)

(52) U.S. Cl.
CPC ..... *B41J 2/19* (2013.01)

(58) Field of Classification Search
CPC ..... B41J 2/19; B41J 2/175
See application file for complete search history.

(56) References Cited

U.S. PATENT DOCUMENTS 6,929,362 B2 8/2005 Takada et al.
6,932,465 B2 8/2005 Nito et al.
6,935,732 B2 8/2005 Takada et al.
7,276,110 B2 10/2007 Tsujimura et al.
7,297,203 B2 11/2007 Takada et al.
7,354,145 B2 4/2008 Nito et al.
7,377,631 B2 5/2008 Takada et al.
7,517,073 B2 4/2009 Nito et al.
7,705,071 B2 4/2010 Nakagawa et al.
7,824,020 B2 * 11/2010 Saito ..... B29C 53/38 347/84

(Continued)

FOREIGN PATENT DOCUMENTS

JP 2004-136580 A 5/2004
JP 2004136580 A * 5/2004

(Continued)

OTHER PUBLICATIONS

Sato, MachineTranslationofJP 2004136580 A, 2004.*

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

An ink jet recording method using an ink jet recording apparatus having a first ink storage portion, a second ink storage portion, a tube that supplies an aqueous ink from the first ink storage portion to the second ink storage portion, a mechanism that blocks the tube, and a recording head communicating with the second ink storage portion, the method including ejecting the aqueous ink from the recording head to record an image on a recording medium. The tube has an aeration amount (μL/day) of 10 μL/day or more to 60 μL/day or less at a temperature of 40° C. The aqueous ink contains a coloring material and a first water-soluble organic solvent having a dielectric constant of 34.0 or less at a temperature of 25° C.

6 Claims, 2 Drawing Sheets

(56) References Cited

U.S. PATENT DOCUMENTS

| | | | | |
|---|---|---|---|---|
| 7,918,928 | B2 | 4/2011 | Saito et al. | |
| 8,013,051 | B2 | 9/2011 | Takada et al. | |
| 8,342,663 | B2 | 1/2013 | Nagaoka et al. | |
| 8,389,600 | B2 | 3/2013 | Suzuki et al. | |
| 8,469,504 | B2 | 6/2013 | Saito et al. | |
| 8,871,013 | B2 | 10/2014 | Sakai et al. | |
| 8,932,394 | B2 | 1/2015 | Kudo et al. | |
| 8,986,435 | B2 | 3/2015 | Saito et al. | |
| 8,992,674 | B2 | 3/2015 | Ikegami et al. | |
| 9,090,789 | B2 | 7/2015 | Hakamada et al. | |
| 9,453,138 | B2 | 9/2016 | Shimizu et al. | |
| 2010/0034972 | A1 | 2/2010 | Mukae et al. | |
| 2012/0033021 | A1 | 2/2012 | Nagaoka et al. | |
| 2014/0364548 | A1* | 12/2014 | Everhardus ..... | C09D 11/322 524/166 |
| 2016/0280945 | A1 | 9/2016 | Mukae et al. | |

FOREIGN PATENT DOCUMENTS

| | | | |
|---|---|---|---|
| JP | 2007-196466 | A | 8/2007 |
| JP | 2012-051368 | A | 3/2012 |

* cited by examiner

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

An ink jet recording method enables recording of images on various recording media. In order to produce better images, various inks, such as inks suited for recording photographic quality images on glossy paper and the like and inks suited for recording documents on plain paper and the like, have been developed according to purposes.

In recent years, the ink jet recording method is also used, for example, for recording business documents containing characters, diagrams, and the like on plain paper or similar recording media, and has been markedly frequently used for such purposes.

As the technique of the ink jet recording method develops, ink jet recording apparatuses are required to have higher durability and reliability in order to be usable for a long period of time and also to enable recording of a larger number of images, thereby achieving high productivity.

In order to improve the productivity, an ink jet recording apparatus in which a main tank and a sub tank are provided as ink storage portions and are connected through an ink supply tube is known, for example. The sub tank is typically provided on the top of a recording head installed on a carriage. When an ink jet recording apparatus having the above-mentioned structure is used to record images, an ink supply tube that has one end connected to the main tank and the other end connected to the sub tank is pulled around in the apparatus by bi-directional scanning of the carriage. On this account, the material of the tube is selected from the materials having sufficient flexibility to withstand the bi-directional scanning of the carriage. In particular, recent ink jet recording apparatuses have been further downsized, and members of the apparatuses are required to be arranged in a compact space. To meet this demand, the tube is required to have higher flexibility.

From a tube filled with an ink, components such as water pass through the tube to evaporate depending on the material of the tube. Such a phenomenon increases the viscosity of the ink due to evaporation of water and the like, and this is likely to deteriorate ejection stability of the ink. In addition, the composition of the ink is changed due to a reduction of water content and the like, and this is likely to cause problems such as quality deterioration of images recorded. In other words, the material of a tube is required to be selected in consideration of images to be recorded. Meanwhile, when air passes through a tube from the outside to the inside and is mixed with an ink, the dissolved air amount in the ink increases. When the air having dissolved in the ink forms bubbles due to any stimulus, the ink in the tube contains the bubbles. When the ink containing bubbles is supplied to a recording head, the bubbles are likely to cause problems including ink ejection failure. In other words, the material of a tube is required to be selected also in consideration of ink ejection stability.

As an ink supply tube, a tube having higher moisture barrier performance, air barrier performance, and kink resistance is disclosed. The tube is formed of a resin material including a thermoplastic elastomer containing a particular block copolymer and a lubricant component at a particular ratio (Japanese Patent Application Laid-Open No. 2012-051368). In order to improve the ejection stability of an ink, ink jet recording apparatuses are disclosed. In the apparatuses, the moisture permeability of members constituting the recording apparatus, such as a main tank, a recording head, and a tube, the viscosity and the surface tension of an ink after evaporation are controlled within particular ranges, for example (Japanese Patent Application Laid-Open No. 2007-196466 and Japanese Patent Application Laid-Open No. 2004-136580).

In order to improve the productivity, the inventors of the present invention have studied the material of an ink supply tube by using an ink jet recording apparatus having a structure in which a main tank and a sub tank are provided as the ink storage portions and these tanks are connected through an ink supply tube. The result reveals that images recorded are unlikely to be deteriorated even when the tube disclosed in Japanese Patent Application Laid-Open No. 2012-051368 is used and an ink is ejected over a long period of time.

In a typical ink jet recording apparatus, a water head difference of liquid levels, a negative pressure generation member, or the like is used to maintain a negative pressure of an ink supply system, thereby preventing an ink from leaking from an ejection orifice on a recording head. In other words, the ink supply system is required to maintain a negative pressure constantly. In the ink jet recording apparatus having the structure in which a main tank and a sub tank are provided as the ink storage portions and these tanks are connected through an ink supply tube, the ink supply system is in an open system condition when an ink is injected into the main tank. On this account, the negative pressure of the ink supply system is not maintained when an ink is injected, and accordingly the ink may leak from an ejection orifice on a recording head. In order to maintain a negative pressure of the ink supply system even when an ink is injected into a main tank, a mechanism of blocking an ink supply tube is required to be provided.

However, the study by the inventors of the present invention has revealed the following new problem. When the ink supply tube disclosed in Japanese Patent Application Laid-Open No. 2012-051368 is blocked when an ink is injected into a main tank, the crept tube remains even after the release of blocking, and it is difficult to stably supply the ink.

An object of the present invention is thus to solve the problems caused when an ink jet recording apparatus including a main tank, a sub tank, an ink supply tube connecting the tanks, and a mechanism of blocking the ink supply tube is used over a long period of time. In other words, the present invention aims to provide an ink jet recording method that enables the above ink jet recording apparatus to maintain good ink ejection stability even when the ink jet recording apparatus is used over a long period of time and to stably supply an ink even after release of blocking of the ink supply tube. The present invention also aims to provide an ink jet recording apparatus used in the ink jet recording method.

SUMMARY OF THE INVENTION

The above objects are achieved by the following present invention. The present invention provides an ink jet recording method using an ink jet recording apparatus including a first ink storage portion, a second ink storage portion, a tube that supplies an aqueous ink from the first ink storage portion to the second ink storage portion, a mechanism that blocks the tube, and a recording head communicating with the second ink storage portion, the method including ejecting the aqueous ink from the recording head to record an image on a recording medium. In the method, the tube has an aeration amount (μL/day) of 10 μL/day or more to 60 μL/day or less at a temperature of 40° C., and the aqueous ink contains a coloring material and a first water-soluble organic solvent having a dielectric constant of 34.0 or less at a temperature of 25° C.

The present invention can solve the problems caused when an ink jet recording apparatus including a main tank, a sub tank, an ink supply tube connecting the tanks, and a mechanism of blocking the ink supply tube is used over a long period of time. In other words, the present invention can provide an ink jet recording method that enables the above ink jet recording apparatus to maintain good ink ejection stability even when the ink jet recording apparatus is used over a long period of time and to stably supply an ink even after release of blocking of the ink supply tube. According to the present invention, an ink jet recording apparatus used in the ink jet recording method can also be provided.

Further features of the present invention will become apparent from the following description of exemplary embodiments with reference to the attached drawings.

DESCRIPTION OF THE EMBODIMENTS

Figure 1:
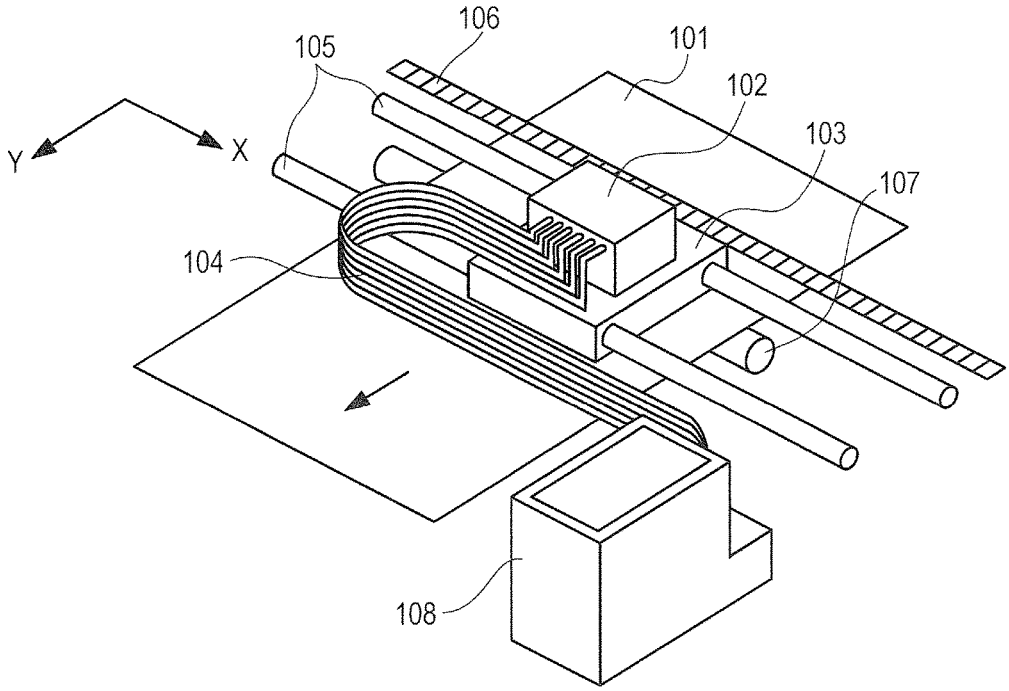
FIG. 1 is a perspective view schematically showing an embodiment of an ink jet recording apparatus of the present invention.

Preferred embodiments of the present invention will now be described in detail in accordance with the accompanying drawings. In the present invention, when a compound is a salt, the salt dissociates into ions in an ink, but such an ink is expressed as "containing a salt" for convenience. An aqueous ink for ink jet may be simply called "ink", a first ink storage portion may be simply called "main tank", and a second ink storage portion may simply called "sub tank". Physical property values are values determined at normal temperature (25° C.) unless otherwise noted.

First, the inventors of the present invention have studied a tube that has been crept but is readily returned when the tube is released from blocking, or a tube having good creep resistance. Specifically, the inventors have studied constituent materials of a tube, the type of additives such as a lubricant and a softener, and physical properties such as hardness and gas barrier properties of a tube, and evaluated the creep resistance of a tube. As a result, the inventors have found a correlation between the aeration amount and the creep resistance of a tube. Specifically, it has been revealed that (i) a tube having a low aeration amount and high gas barrier properties has poor creep resistance and (ii) a tube having a large aeration amount and low gas barrier properties has excellent creep resistance.

If the creep resistance is insufficient, an ink cannot be supplied stably. On this account, a tube is required to be selected in terms of ensuring the creep resistance. The inventors of the present invention thus connected an ink storage portion to a recording head installed on a carriage through a tube having good creep resistance, and recorded images while an ink was supplied from the ink storage portion to the recording head through the tube. The result has revealed that, when images are recorded over a long period of time, the ejection stability of an ink deteriorates as the number of ejection actions increases, and images deteriorate. When similar studies were further performed while the type of the tube was changed. The result has indicated a correlation between the number of ejection actions when an image deteriorates and the aeration amount of a tube, and has revealed that a tube having a larger aeration amount causes image deterioration at a smaller number of ejection actions. In other words, it has been revealed that the creep resistance of a tube and the ejection stability of an ink are in what is called a trade-off relation.

Hence, the inventors of the present invention have further conducted studies in order to satisfy both the creep resistance and the ejection stability. First, the cause of the problem that images are likely to deteriorate as the number of ejection actions increases was studied. An increase of the number of ejection actions means that a recording apparatus are used over a longer period of time. Bubbles generated in a tube when a recording apparatus is used are supplied together with an ink through a sub tank to a recording head. It has been revealed that bubbles thus adhere to an ink flow path of the recording head and prevent normal ejection of the ink. The process of generating bubbles in a tube was further observed in detail. The result has indicated that air passes through a wall material constituting the tube to generate bubbles in an ink in the tube and that the generated bubbles gradually grow.

Next, the inventors of the present invention have studied the technique for suppressing deterioration of the ejection stability of an ink even when a tube having a large aeration amount for ensuring the creep resistance is used. Specifically, the inventors have supposed that the deterioration of the ejection stability due to generation of bubbles as described above can be suppressed by a reduction of the amount of air infiltrated in a tube and have performed various experiments. As a result, it has been revealed that the ejection stability of an ink is maintained when the ink contains a water-soluble organic solvent having a dielectric constant of 34.0 or less at a temperature of 25° C. (hereinafter also called "first water-soluble organic solvent"). The inventors of the present invention suggest that the reason why such an effect is achieved is the following mechanisms.

A water-soluble organic solvent having a lower dielectric constant is likely to have high hydrophobicity. A flexible tube is composed of a highly hydrophobic material such as styrenic or olefinic thermoplastic elastomers. This indicates that a water-soluble organic solvent having a low dielectric constant has high affinity with the material constituting a tube. When a tube is filled with an ink, the first water-soluble organic solvent having high affinity with the material constituting the tube is oriented on the inner wall of the tube. It is supposed that the inner wall surface and the vicinity thereof in the tube then swell due to the first water-soluble organic solvent, and fine pores are filled.

A water-soluble organic solvent having a lower dielectric constant is likely to have high solubility of gas such as air. The first water-soluble organic solvent has high solubility of gas such as air as compared with water and a water-soluble organic solvent having a dielectric constant of more than 34.0 at a temperature of 25° C. Air that passes from the outside of a tube into the tube is dissolved in the first water-soluble organic solvent that is oriented on the inner wall of the tube, near the inner wall of the tube. This is supposed to suppress the generation of bubbles. In other words, it is supposed that the inner wall and the vicinity thereof in the tube swell due to the first water-soluble organic solvent, infiltrated air is dissolved in the first water-soluble organic solvent, and the synergistic effect thereof improves the ejection stability of an ink.

The tube that supplies an aqueous ink from the first ink storage portion (main tank) to the second ink storage portion (sub tank) is required to have an aeration amount (μL/day) of 10 μL/day or more to 60 μL/day or less at a temperature of 40° C. When a tube has an aeration amount of less than 10 μL/day, the shape of the tube is unlikely to be returned after release of blocking, and the creep resistance is insufficient. When a tube has an aeration amount of more than 60 μL/day, bubbles are generated in the tube depending on recording conditions, and the ink ejection stability is insufficient. The reason why the aeration amount of a tube is determined at a temperature of 40° C. is for ensuring that sufficient effects are achieved also in a common temperature environment by evaluation in a harsher condition than a temperature environment (normal temperature) at which an ink jet recording apparatus is typically used.

Figure 3:
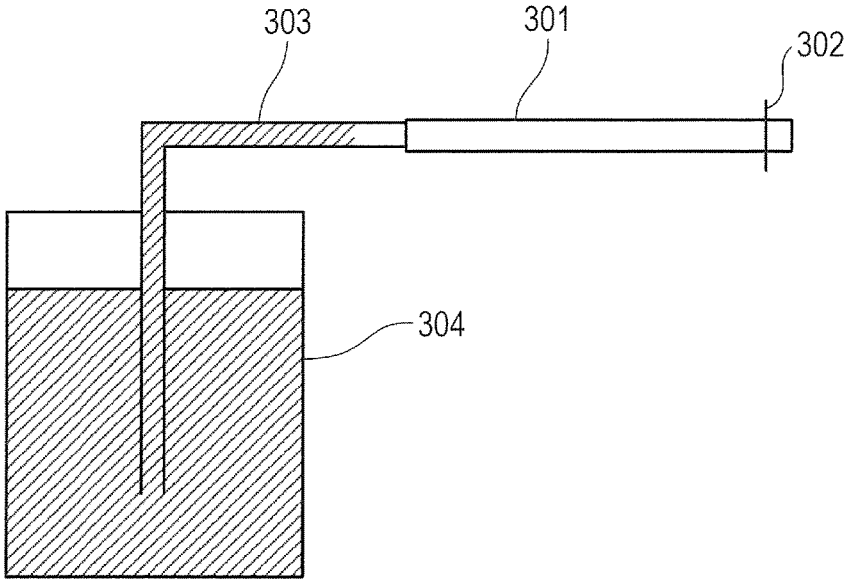
FIG. 3 is a schematic view for describing a measurement method of an aeration amount of a tube.

The aeration amount of a tube can be determined in accordance with the following procedure. FIG. 3 is a schematic view for describing a measurement method of the aeration amount of a tube. As shown in FIG. 3, one end of a tube 301 that has been cut to have any length is sealed with a pinchcock 302, and the other end is connected to one end of an L-shaped 1-mL measuring pipette 303. The other end of the measuring pipette 303 is inserted in water in a container 304. In the above conditions, the whole is allowed to stand in an environment at a temperature of 40° C. and a relative humidity of 20%. The scale on the measuring pipette is periodically recorded, and the amount of air having passed into the tube is determined. In the present invention, the aeration amount of a tube is an amount for a tube length of 100 mm, and the unit is "μL/day".

The ink jet recording method of the present invention and an ink jet recording apparatus, a recording head, an aqueous ink, and the like suitably used in the ink jet recording method will now be described.

<General Structure of Ink Jet Recording Apparatus>

The ink jet recording method of the present invention is a recording method using an ink jet recording apparatus that includes a first ink storage portion, a second ink storage portion, an ink supply tube, a mechanism of blocking the ink supply tube, and a recording head communicating with the second ink storage portion. The ink supply tube is a tube for supplying an aqueous ink from the first ink storage portion to the second ink storage portion. The ink jet recording method of the present invention and an ink jet recording apparatus used in the method will be specifically described hereinafter with reference to drawings.

FIG. 1 is a perspective view schematically showing an embodiment of the ink jet recording apparatus of the present invention. The ink jet recording apparatus of the embodiment shown in FIG. 1 is what is called a serial-type ink jet recording apparatus that records images by bi-directional scanning of a recording head in the X direction (main scanning direction). A recording medium 101 is intermittently conveyed in the Y direction (sub scanning direction) by a conveyor roller 107. A recording unit 102 installed on a carriage 103 is reciprocated and scanned in the X direction (main scanning direction) orthogonal to the Y direction that is the conveyance direction of the recording medium 101. By the conveyance of the recording medium 101 in the Y direction and the bi-directional scanning of the recording unit 102 in the X direction, recording is performed.

Figure 2:
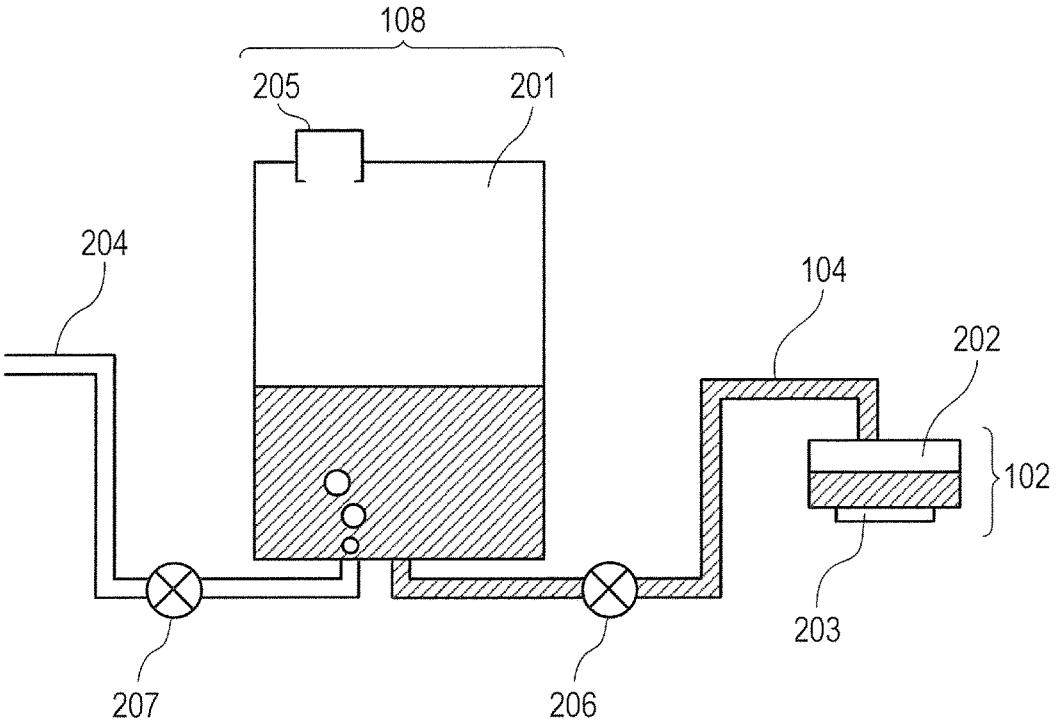
FIG. 2 is a schematic view showing an example of an ink supply system.

FIG. 2 is a schematic view showing an example of an ink supply system. As shown in FIG. 2, the recording unit 102 includes an ink jet recording head 203 having a plurality of ejection orifices from which a supplied ink is ejected and includes a sub tank 202 as the second ink storage portion. The recording unit 102 is installed on a carriage 103 as shown in FIG. 1. The carriage 103 is supported in such a way as to be movable along guide rails 105 placed along the X direction and is fixed to an endless belt 106 that moves in parallel with the guide rails 105. The endless belt 106 reciprocates by the driving force of a motor. The carriage 103 is reciprocated and scanned in the X direction by the reciprocation of the endless belt 106.

As shown in FIG. 2, a main tank 201 as the first ink storage portion is stored in a main tank storage portion 108. The main tank 201 in the main tank storage portion 108 and the sub tank 202 in the recording unit 102 are connected through an ink supply tube 104. An ink is supplied from the main tank 201 to the sub tank 202 through the ink supply tube 104 and then is ejected from the ejection orifices on the recording head 203. The numbers of main tanks, sub tanks, and ink supply tubes may correspond to the number of inks.

An ink (indicated by the hatching) stored in the main tank 201 is supplied through the ink supply tube 104 to the sub tank 202 and then is supplied to the recording head 203. To the main tank 201, a gas inlet tube 204 as an atmosphere communicating portion is connected. When an ink is consumed by image recording, a corresponding ink is supplied from the main tank 201 to the sub tank 202, and the ink in the main tank 201 is reduced. When the ink in the main tank 201 is reduced, air is introduced from the gas inlet tube 204 having one end open to the atmosphere, into the main tank 201, and thus a negative pressure for holding an ink in the ink supply system is kept substantially constant.

The main tank 201 preferably has a maximum ink volume $V_1$ (mL) of 60.0 mL or more to 200.0 mL or less and more preferably 60.0 mL or more to 150.0 mL or less. The sub tank 202 preferably has a maximum ink volume $V_2$ (mL) of 1.0 mL or more to 35.0 mL or less, more preferably 2.0 mL or more to 20.0 mL or less, and particularly preferably 5.0 mL or more to 15.0 mL or less.

When the ink stored in the main tank 201 is reduced, a first valve 206 is activated to block the ink supply tube 104, then a lid 205 of the main tank 201 is opened, and a corresponding ink is injected into the main tank 201. If the first valve 206 is not activated, thus the ink supply tube 104 is not blocked, and the lid 205 of the main tank 201 is opened, the negative pressure for holding an ink is lost, and the ink leaks from the ejection orifices on the recording head 203. When an ink is injected into the main tank 201, a second valve 207 can also be activated to block the gas inlet tube 204, and then the lid 205 can be opened. By such a structure, an ink can be prevented from flowing from the main tank 201 to the direction of the gas inlet tube 204. The first valve 206 and the second valve 207 are preferably activated in an interlocking manner, and thus an ink can be prevented from leaking more reliably.

The ink supply tube 104 is connected to the sub tank 202 that is included in the recording unit installed on the carriage 103. Due to such a structure, the ink supply tube 104 is pulled around in the apparatus by bi-directional scanning of the carriage 103. On this account, the material constituting the ink supply tube 104 is required to be selected from the materials having sufficient flexibility to withstand frequent bi-directional scanning of the carriage 103. In the present invention, the tube is required to have an aeration amount (μL/day) of 10 μL/day or more to 60 μL/day or less at a temperature of 40° C. The aeration amount (μL/day) of the tube at a temperature of 40° C. is preferably 20 μL/day or more to 40 μL/day or less and more preferably 24 μL/day or more to 36 μL/day or less. When a tube having an aeration amount within this range at a temperature of 40° C. is used, the creep resistance of the tube and the ejection stability of an ink can be satisfied at higher levels. If the aeration amount is less than the lower limit, the creep resistance may deteriorate, and if the aeration amount is more than the upper limit, the ejection stability may deteriorate. The material constituting the ink supply tube 104 may be the same as or different from the material constituting the gas inlet tube 204. Tubes made of the same material and having the same characteristics are preferably used.

The ink supply tube is a member that has the above aeration amount and is formed in a tubular shape. The ink supply tube may be formed of any material having the predetermined aeration amount. As the ink supply tube, a resin tube is preferred. The tube may be formed of a single resin material or a combination of two or more resin materials. The resin material may contain various additives. The structure of the tube may be a single layer structure or a multilayer structure. As the constituent material of the tube, a thermoplastic elastomer is preferred because of excellent moldability, rubber elasticity, and flexibility. The thermoplastic elastomer is exemplified by olefinic resins, urethane resins, ester resins, styrenic resins, and vinyl chloride resins. Of them, styrenic thermoplastic elastomers are preferred because of particularly excellent flexibility and rubber elasticity. Additives contained in the resin material are exemplified by a softener, a lubricant, a surfactant, an antioxidant, an age inhibitor, an adhesiveness imparting agent, and a pigment.

The inner diameter and the wall thickness of the tube can be appropriately set in terms of productivity including moldability, flexural rigidity when a tube is pulled around in a recording apparatus, ink supply properties, and gas barrier properties, for example. For example, the inner diameter of the tube is preferably 1 mm or more to 5 mm or less and more preferably 1 mm or more to 3 mm or less. The wall thickness of the tube is preferably 0.5 mm or more to 5 mm or less and more preferably 0.5 mm or more to 3 mm or less.

The first ink storage portion and the second ink storage portion (housings) can be formed of a thermoplastic resin such as polyester, polycarbonate, polypropylene, polyethylene, polystyrene, and polyphenylene ether; or a mixture or a modified material of such thermoplastic resins, for example. In the housing, an ink absorber capable of generating a negative pressure for holding an ink may be provided. The ink absorber is preferably compressed fibers made of a resin such as polypropylene and polyurethane. Alternatively, no ink absorber is provided in a housing, and an ink may be directly stored in the housing.

The recording unit 102 of the embodiment shown in FIG. 2 includes the recording head 203 and the sub tank 202. A recording unit as a head cartridge in which the sub tank is installed and the recording head is integrated may be installed on the carriage. A recording unit in which the sub tank and the recording head are integrally formed may be installed on the carriage. In the present invention, a cartridge type recording unit 102 in which the sub tank 202 as the second ink storage portion and the recording head 203 are integrally formed is preferably installed on the carriage 103 as shown in FIGS. 1 and 2. Specifically, the sub tank as the second ink storage portion is preferably a housing made of a thermoplastic resin, and a recording element substrate including the recording head is preferably bonded directly to the sub tank without interposing other members such as a heat-dissipating plate.

The ink ejection system of the recording head is exemplified by a system of applying mechanical energy to an ink by a piezo element or the like to eject the ink and a system of applying thermal energy to an ink by an electrothermal converter or the like to eject the ink. In the present invention, the system of applying thermal energy to an ink to eject the ink is preferably adopted.

<Aqueous Ink>

In the ink jet recording method of the present invention, an aqueous ink is ejected from a recording head to record an image on a recording medium. In the ink jet recording method of the present invention, a liquid that causes reaction or viscosity increase on contact with an aqueous ink is not necessary used in combination. The aqueous ink contains a coloring material and a first water-soluble organic solvent having a dielectric constant of 34.0 or less at a temperature of 25° C. The aqueous ink will next be described in detail.

Coloring Material

As the coloring material, a pigment or a dye can be used. In the aqueous ink, the content (% by mass) of the coloring material is preferably 0.1% by mass or more to 15.0% by mass or less and more preferably 1.0% by mass or more to 10.0% by mass or less based on the total mass of the ink.

When a pigment is used as the coloring material, the dispersion method of the pigment is not limited to particular methods. For example, a resin-dispersed pigment dispersed by a resin dispersant, a pigment dispersed by a surfactant, and a microcapsule pigment prepared by covering at least a part of the particle surface of a pigment with a resin or the like can be used. In addition, a self-dispersible pigment prepared by bonding a functional group including a hydrophilic group such as an anionic group to the particle surface of a pigment and a pigment prepared by chemically bonding an organic group including a polymer to the particle surface of a pigment (resin-bonded self-dispersible pigment) can also be used. Needless to say, pigments different in dispersion methods can be used in combination.

The pigment usable as the coloring material is not limited to particular types. Specific examples of the pigment include inorganic pigments such as carbon black; and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more of them as needed.

The dye usable as the coloring material is not limited to particular types. Specific examples of the dye include direct dyes, acid dyes, basic dyes, disperse dyes, and food dyes. Of them, a dye having an anionic group is preferably used. Specific examples of the dye skeleton include azo, triphenylmethane, phthalocyanine, azaphthalocyanine, xanthene, and anthrapyridone.

As the pigment, a self-dispersible pigment is preferably used. Self-dispersible pigments have high hydrophobicity and low affinity with bubbles, and thus can effectively suppress deterioration of the ejection stability even when a recording apparatus is used over a long period of time. Specifically, a self-dispersible pigment in which a carboxylic acid group is directly bonded to the particle surface of the pigment is preferably used. The self-dispersible pigment in which a carboxylic acid group is directly bonded to the particle surface of the pigment is typically produced by oxidation treatment of a pigment. The oxidation treatment roughens the particle surface of a pigment to increase the hydrophobicity, and thus the pigment has lower affinity with bubbles. Hence, by using the self-dispersible pigment in which a carboxylic acid group is directly bonded to the particle surface of the pigment, deterioration of the ejection stability can be particularly efficiently suppressed even when an ink is ejected over a long period of time.

As the dye, an azo dye or a phthalocyanine dye is preferably used. When such a dye is used, images having excellent color developability can be recorded on a recording medium such as plain paper, and the reliability of an ink is improved. Such a dye is thus preferred. As the azo dye, C.I. Acid Red 249 or C.I. Direct Yellow 132 is preferred, for example. As the phthalocyanine dye, C.I. Direct Blue 199 is preferred, for example.

In the present invention, the relation between a hue and a coloring material of an ink is preferably the following relations. The "hue" of an ink means a hue classified into black, color, and the like, and the color hue includes cyan, magenta, yellow, red, green, blue, and the like. For a black ink, a self-dispersible pigment is preferably used as the coloring material, and a self-dispersible pigment in which a carboxylic acid group is directly bonded to the particle surface of the pigment is particularly preferred. For a color ink, a dye is preferably used as the coloring material.

First Water-Soluble Organic Solvent

The aqueous ink contains a first water-soluble organic solvent having a dielectric constant of 34.0 or less at a temperature of 25° C. When only a water-soluble organic solvent having a dielectric constant of more than 34.0 is used, the creep resistance is insufficient. In the aqueous ink, the content (% by mass) of the first water-soluble organic solvent is preferably 1.0% by mass or more to 50.0% by mass or less and more preferably 3.0% by mass or more to 30.0% by mass or less based on the total mass of the ink.

The dielectric constant of a water-soluble organic solvent can be determined by using a dielectric constant meter (for example, trade name "BI-870" (manufactured by BROOKHAVEN INSTRUMENTS CORPORATION)) at a frequency of 10 kHz. The dielectric constant of a water-soluble organic solvent that is solid at a temperature of 25° C. can be determined by measuring the dielectric constant of 50% by mass aqueous solution and calculating the objective dielectric constant in accordance with Equation (1). Although "water-soluble organic solvent" typically means a liquid, a solvent that is solid at 25° C. (normal temperature) is also included in the water-soluble organic solvent in the present invention.

$$\in_{sol}=2\in_{50}-\in_{water} \quad (1)$$

$\in_{sol}$: dielectric constant of a water-soluble organic solvent solid at 25° C.

$£_{50}$%: dielectric constant of 50% by mass aqueous solution of the water-soluble organic solvent solid at 25° C.

$\in_{water}$ dielectric constant of water

Specific examples of the water-soluble organic solvent that is generally used in aqueous inks and is solid at 25° C. include 1,6-hexanediol, trimethylolpropane, ethylene urea, urea, and polyethylene glycol having a number average molecular weight of 1,000.

The reason why the dielectric constant of a water-soluble organic solvent solid at 25° C. is calculated from the dielectric constant of 50% by mass aqueous solution is as described below. Some of the water-soluble organic solvents that are solid at 25° C. and usable as a component of an aqueous ink are difficult to give an aqueous solution having a high concentration of more than 50% by mass. Meanwhile, the dielectric constant of an aqueous solution having a low concentration of 10% by mass or less is dominated by the dielectric constant of water. It is thus difficult to determine the probable (practical) dielectric constant value of such a water-soluble organic solvent. Hence, the inventors of the present invention have studied and found that most of the water-soluble organic solvents that are solid at 25° C. and usable in inks can give a measurable aqueous solution and the calculated dielectric constants match with the advantageous effects of the invention. For the above reason, the dielectric constant of a water-soluble organic solvent solid at 25° C. is intended to be calculated from the dielectric constant of 50% by mass aqueous solution in the present invention. For a water-soluble organic solvent that is solid at 25° C. but has a low solubility in water and cannot give 50% by mass aqueous solution, an aqueous solution at saturated concentration is used, and the dielectric constant is calculated in accordance with the above calculation of $\in_{sol}$ and is used expediently.

Specific examples of the first water-soluble organic solvent include trimethylolpropane (33.7), methanol (33.1), N-methyl-2-pyrrolidone (32.0), triethanolamine (31.9), diethylene glycol (31.7), 1,4-butanediol (31.1), 1,3-butanediol (30.0), 1,2-propanediol (28.8), 1,2,6-hexanetriol (28.5), 2-methyl-1,3-propanediol (28.3), 2-pyrrolidone (28.0), 1,5-pentanediol (27.0), 3-methyl-1,3-butanediol (24.0), 3-methyl-1,5-pentanediol (23.9), ethanol (23.8), 1-(hydroxymethyl)-5,5-dimethylhydantoin (23.7), triethylene glycol (22.7), polyethylene glycol having a number average molecular weight of 200 (18.9), 2-ethyl-1,3-hexanediol (18.5), isopropanol (18.3), 1,3-bis(2-hydroxyethyl)-5,5-dimethylhydantoin (16.0), 1,2-hexanediol (14.8), polyethylene glycol having a number average molecular weight of 600 (11.4), triethylene glycol monobutyl ether (9.8), 1,6-hexanediol (7.1), and polyethylene glycol having a number average molecular weight of 1,000 (4.6) (the values in the parentheses are dielectric constants at 25° C.). The first water-soluble organic solvent preferably has a dielectric constant of 3.0 or more. The first water-soluble organic solvent preferably has a lower vapor pressure than that of water at 25° C.

The aqueous ink preferably contains a water-soluble organic solvent having a dielectric constant of 27.0 or less at a temperature of 25° C. (hereinafter also called "second water-soluble organic solvent"), amongst the first water-soluble organic solvents. In the aqueous ink, the content (% by mass) of the second water-soluble organic solvent is preferably 8.5% by mass or more to 14.5% by mass or less based on the total mass of the ink. By using an aqueous ink containing the second water-soluble organic solvent within this range, the ejection stability of the ink can be maintained at a higher level even when a recording apparatus is used to eject the ink over a long period of time. If the content (% by mass) of the second water-soluble organic solvent is less than 8.5% by mass, the action of swelling the inner wall and the vicinity thereof of a tube to prevent air from infiltrating may be reduced, and the ejection stability of the ink is slightly reduced in some cases. If the content (% by mass) of the second water-soluble organic solvent is more than 14.5% by mass, the content of a water-soluble organic solvent having a low dielectric constant increases in the ink, and the dissolved air amount increases in the ink. Accordingly, bubbles may be likely to be generated in a tube, and thus the ejection stability of the ink slightly deteriorates in some cases.

Specific examples of the second water-soluble organic solvent include solvents having a dielectric constant of 27.0 or less at a temperature of 25° C. among the above specific examples of the first water-soluble organic solvent. Specifically, the second water-soluble organic solvent is preferably an alkanediol having a hydroxy group at each terminal of a hydrocarbon chain (at each terminal of the longest hydrocarbon chain in the case of a branched alkanediol). Specific examples of such an alkanediol include 3-methyl-1,5-pentanediol (23.9), 1,5-pentanediol (27.0), and 1,6-hexanediol (7.1) (the values in the parentheses are dielectric constants at 25° C.). These alkanediols have a hydroxy group at each terminal of a hydrocarbon chain, and thus exhibit surfactant-like behavior. In addition, the structure of an alkyl group as a hydrophobic group is linear, and thus the alkanediols are likely to be densely oriented on the inner wall of a tube. Hence, by using such an alkanediol, the ejection stability of an ink can be further improved. Of the above alkanediols, alkanediols having a branched hydrocarbon chain, such as 3-methyl-1,5-pentanediol, are particularly preferred. An alkanediol containing a branched hydrocarbon chain (preferably at the center) has higher affinity with the inner wall of a tube and thus is more densely oriented on the inner wall of a tube. Accordingly, air can be more effectively prevented from infiltrating from the outside of a tube, and the ejection stability of an ink can be further improved.

Aqueous Medium

The aqueous ink can contain an aqueous medium that is a mixed solvent of water and a water-soluble organic solvent. As the water, deionized water or ion-exchanged water is preferably used. In the aqueous ink, the content (% by mass) of water is preferably 50.0% by mass or more to 95.0% by mass or less based on the total mass of the ink.

As the water-soluble organic solvent, at least the first water-soluble organic solvent is used. As a water-soluble organic solvent other than the first water-soluble organic solvent, a water-soluble organic solvent having a dielectric constant of more than 34.0 at a temperature of 25° C. (hereinafter also called "third water-soluble organic solvent", for convenience) can be used in combination. As the third water-soluble organic solvent, one or more solvents usable in ink jet inks can be used. In the ink, the content (% by mass) of the water-soluble organic solvents (including the first water-soluble organic solvent) is preferably 1.0% by mass or more to 50.0% by mass or less based on the total mass of the ink.

Specific examples of the water-soluble organic solvent (including specific examples of the first, second and third water-soluble organic solvent) include monohydric alcohols having 1 to 4 carbon atoms, such as methanol (33.1), ethanol (23.8), n-propanol, isopropanol (18.3), n-butanol, sec-butanol, and tert-butanol; dihydric alcohols such as 1,2-propanediol (28.8), 1,3-butanediol (30.0), 1,4-butanediol (31.1), 1,5-pentanediol (27.0), 1,2-hexanediol (14.8), 1,6-hexanediol (7.1), 2-methyl-1,3-propanediol (28.3), 3-methyl-1,3-butanediol (24.0), 3-methyl-1,5-pentanediol (23.9), and 2-ethyl-1,3-hexanediol (18.5); polyhydric alcohols such as 1,2,6-hexanetriol (28.5), glycerol (42.3), trimethylolpropane (33.7), and trimethylolethane; alkylene glycols such as ethylene glycol (40.4), diethylene glycol (31.7), triethylene glycol (22.7), tetraethylene glycol, butylene glycol, hexylene glycol, and thiodiglycol; glycol ethers such as diethylene glycol monomethyl ether, diethylene glycol monoethyl ether, triethylene glycol monoethyl ether, and triethylene glycol monobutyl ether (9.8); polyalkylene glycols having a number average molecular weight of 200 to 1,000, such as polyethylene glycol having a number average molecular weight of 200 (18.9), polyethylene glycol having a number average molecular weight of 600 (11.4), polyethylene glycol having a number average molecular weight of 1,000 (4.6), and polypropylene glycol; nitrogen-containing compounds such as 2-pyrrolidone (28.0), N-methyl-2-pyrrolidone (32.0), 1-(2-hydroxyethyl)-2-pyrrolidone (37.6), 1,3-dimethyl-2-imidazolidinone, N-methylmorpholine, urea (110.3), ethylene urea (49.7), triethanolamine (31.9), 1-hydroxymethyl-5,5-dimethylhydantoin (23.7), and 1,3-bis(2-hydroxyethyl)-5,5-dimethylhydantoin (16.0); sulfur-containing compounds such as dimethyl sulfoxide (48.9) and bis(2-hydroxyethyl sulfone); and cyclic ethers such as γ-butyrolactone (41.9) (the values in the parentheses are dielectric constants at 25° C.). The water-soluble organic solvent preferably has a dielectric constant of 3.0 or more to 120.0 or less. The water-soluble organic solvent preferably has a lower vapor pressure than that of water at 25° C.

When an aqueous ink containing the third water-soluble organic solvent having a dielectric constant of more than 34.0 at a temperature of 25° C. is used, the sticking resistance of the ink in a recording head can be improved, and thus such an aqueous ink is preferred. Specifically, a water-soluble organic solvent having a high dielectric constant, such as ethylene urea and glycerol, is preferably used as the third water-soluble organic solvent.

Other Components

The aqueous ink may contain various additives such as a surfactant, an antifoaming agent, a pH adjuster, an antiseptic agent, an antifungal agent, an antioxidant, and a reduction inhibitor, as needed. Such an additive is contained in an ink typically at a considerably small content and thus has a small influence on advantageous effects of the present invention. On this account, such an additive is not included in the "water-soluble organic solvent" in the present invention and is eliminated from the calculation of the dielectric constant.

Physical Properties of Aqueous Ink

The aqueous ink preferably has a viscosity of 1.0 mPa·s or more to 5.0 mPa·s or less and more preferably 1.0 mPa·s or more to 3.0 mPa·s or less at 25° C. The ink preferably has a static surface tension of 25 mN/m or more to 45 mN/m or less at 25° C. The ink preferably has a pH of 5 or more to 9 or less at 25° C.

Examples

The present invention will next be described in further detail with reference to examples and comparative examples, but the invention is not intended to be limited to the following examples without departing from the gist of the invention. The component amounts with "part" or "%" are based on mass unless otherwise noted.

<Preparation of Pigment Dispersion Liquid>

Pigment Dispersion Liquid 1

A solution prepared by dissolving 5.0 g of concentrated sulfuric acid in 5.5 g of water was cooled to 5° C., and 1.6 g of 4-aminophthalic acid was added to the solution. A container containing the solution was placed in an ice bath, and to the solution, a solution prepared by dissolving 2.2 g of sodium nitrite in 9.0 g of water at 5° C. was added while the solution was stirred to maintain the temperature at 10° C. or less. After stirring for 15 minutes, 6.0 g of carbon black (with a specific surface area of 220 $m^2/g$, a DBP oil absorption amount of 105 mL/100 g) was added under stirring, and the whole was further stirred for minutes, giving a slurry. The obtained slurry was filtered through a filter paper (trade name "standard filter paper No. 2", manufactured by ADVANTEC), and the particles were sufficiently cooled with water and were dried in an oven at 110° C. Sodium ions were replaced with potassium ions by an ion exchange method, and then pure water was added so as to give a pigment content of 10.0%, giving a pigment dispersion liquid 1. The obtained pigment dispersion liquid 1 contained a self-dispersible pigment in which a —$C_6H_3$—$(COOK)_2$ group was bonded to the particle surface of the pigment.

Pigment Dispersion Liquid 2

First, 500 g of ion-exchanged water and 15.0 g of carbon black (with a specific surface area of 220 $m^2/g$, a DBP oil absorption amount of 105 mL/100 g) were mixed, and the pigment was subjected to preliminary wetting by stirring the mixture at a rotation speed of 15,000 rpm for 30 minutes. To the wet pigment, 4,485 g of ion-exchanged water was added, and the mixture was dispersed with a high-pressure homogenizer, giving a dispersion liquid. The obtained dispersion liquid was placed in a high-pressure container. An ozone water having an ozone concentration of 100 ppm was introduced into the high-pressure container while the content was pressurized at a pressure of 3.0 MPa, and the pigment was subjected to oxidation treatment. To the mixture (liquid) discharged from the high-pressure container, an aqueous potassium hydroxide solution was added to adjust the pH of the liquid to 10.0, and then an appropriate amount of ion-exchanged water was added so as to give a pigment content of 10.0%, giving a pigment dispersion liquid 2. The obtained pigment dispersion liquid 2 contained a self-dispersible pigment in which a —COOK group was bonded to the particle surface of the pigment.

<Preparation of Ink>

Components (unit: %) shown in upper rows in Table 1 were mixed and thoroughly stirred, and the resulting mixtures were subjected to pressure filtration through a microfilter with a pore size of 3.0 μm (manufactured by Fujifilm Corporation), giving each ink. "Acetylenol E 100" in Table 1 is the trade name of a surfactant (ethylene oxide adduct of acetylene glycol) manufactured by Kawaken Fine Chemicals. The lowest row in Table 1 shows contents of water-soluble organic solvents having a dielectric constant of 27.0 or less at a temperature of 25° C. (content A (%) of the second water-soluble organic solvent).

TABLE 1

Composition and properties of ink

| | Ink | | | | | | | | | |
|---|---|---|---|---|---|---|---|---|---|---|
| | 1 | 2 | 3 | 4 | 5 | 6 | 7 | 8 | 9 | 10 |
| C.I. Direct Blue 199 | 3.0 | 3.0 | 3.0 | 3.0 | 3.0 | 3.0 | 3.0 | | | |
| C.I. Acid Red 249 | | | | | | | | 3.0 | | |
| C.I. Direct Yellow 132 | | | | | | | | | 3.0 | |
| Pigment dispersion liquid 1 | | | | | | | | | | 30.0 |
| Pigment dispersion liquid 2 | | | | | | | | | | |
| Ethylene urea (49.7) | | | | | | | 5.0 | | | |
| Glycerol (42.3) | 10.0 | 10.0 | 10.0 | 10.0 | 10.0 | 10.0 | 5.0 | 10.0 | 10.0 | 10.0 |
| Ethylene glycol (40.4) | | | | | | | | | | |
| Trimethylolpropane (33.7) | | | | | | | | | | |
| 1,3-Butanediol (30.0) | | | | | | | | | | |
| 2-Pyrrolidone (28.0) | | | | | | | | | | |
| 1,5-Pentanediol (27.0) | 10.0 | | | | | | | | | |
| 3-Methyl-1,5-pentanediol (23.9) | | 10.0 | | | | | 10.0 | 10.0 | 10.0 | |
| Triethylene glycol (22.7) | | | 10.0 | | | | | | | 10.0 |
| 1,2-Hexanediol (14.8) | | | | 10.0 | | | | | | |
| Triethylene glycol monobutyl ether (9.8) | | | | | 10.0 | | | | | |
| 1,6-Hexanediol (7.1) | | | | | | 10.0 | | | | |
| Acetylenol E 100 | 0.4 | 0.4 | 0.4 | 0.4 | 0.4 | 0.4 | 0.4 | 0.4 | 0.4 | 0.1 |
| Ion-exchanged water | 76.6 | 76.6 | 76.6 | 76.6 | 76.6 | 76.6 | 76.6 | 76.6 | 76.6 | 49.9 |
| Content A (%) of second water-soluble organic solvent | 10.0 | 10.0 | 10.0 | 10.0 | 10.0 | 10.0 | 10.0 | 10.0 | 10.0 | 10.0 |

| | Ink | | | | | | | | | |
|---|---|---|---|---|---|---|---|---|---|---|
| | 11 | 12 | 13 | 14 | 15 | 16 | 17 | 18 | 19 | 20 |
| C.I. Direct Blue 199 | | 3.0 | 3.0 | 3.0 | 3.0 | 3.0 | 3.0 | 3.0 | 3.0 | 3.0 |
| C.I. Acid Red 249 | | | | | | | | | | |
| C.I. Direct Yellow 132 | | | | | | | | | | |
| Pigment dispersion liquid 1 | | | | | | | | | | |
| Pigment dispersion liquid 2 | 30.0 | | | | | | | | | |
| Ethylene urea (49.7) | | | | | | | | | | |
| Glycerol (42.3) | 10.0 | 10.0 | 10.0 | 10.0 | 10.0 | 10.0 | 10.0 | 10.0 | 20.0 | |
| Ethylene glycol (40.4) | | | | | | | | | | 20.0 |
| Trimethylolpropane (33.7) | | 10.0 | | | | | | | | |
| 1,3-Butanediol (30.0) | | | 10.0 | | | | | | | |
| 2-Pyrrolidone (28.0) | | | | 10.0 | | | | | | |
| 1,5-Pentanediol (27.0) | | | | | | | | | | |
| 3-Methyl-1,5-pentanediol (23.9) | | | | | 8.0 | 8.5 | 14.5 | 15.0 | | |
| Triethylene glycol (22.7) | 10.0 | | | | | | | | | |
| 1,2-Hexanediol (14.8) | | | | | | | | | | |
| Triethylene glycol monobutyl ether (9.8) | | | | | | | | | | |
| 1,6-Hexanediol (7.1) | | | | | | | | | | |
| Acetylenol E 100 | 0.1 | 0.4 | 0.4 | 0.4 | 0.4 | 0.4 | 0.4 | 0.4 | 0.4 | 0.4 |
| Ion-exchanged water | 49.9 | 76.6 | 76.6 | 76.6 | 78.6 | 78.1 | 72.1 | 71.6 | 76.6 | 76.6 |
| Content A (%) of second water-soluble organic solvent | 10.0 | 0.0 | 0.0 | 0.0 | 8.0 | 8.5 | 14.5 | 15.0 | 0.0 | 0.0 |

<Preparation of Tube>

In accordance with the method disclosed in Japanese Patent Application Laid-Open No. 2012-051368, a resin tube 1 having an inner diameter of 2 mm and an outer diameter of 4 mm was prepared. Separately, a styrenic thermoplastic elastomer, a lubricant, and a softener were used to prepare tubes 2 to 9 having an inner diameter of 2 mm and an outer diameter of 4 mm. The aeration amounts of the tubes 1 to 9 determined by the above method are shown in Table 2. The aeration amount of a tube is an amount for a tube length L of 100 mm, and the unit is "μL/day".

TABLE 2

Aeration amount of tube

| Tube | Aeration amount (μL/day) |
|---|---|
| 1 | 7 |
| 2 | 10 |
| 3 | 20 |
| 4 | 24 |
| 5 | 30 |
| 6 | 36 |
| 7 | 40 |
| 8 | 60 |
| 9 | 70 |

<Evaluation>

Inks and tubes were used in combinations as shown in the left columns in Table 3, and the following evaluations were performed. In the present invention, "AA", "A", or "B" based on the following criteria was regarded as an acceptable level, and "C" was regarded as an unacceptable level. The evaluation results are shown in the right columns in Table 3.

Ejection Stability

An ink jet recording apparatus that included a principal part with the structure shown in FIG. 1 and was integrated with an ink supply system with the structure shown in FIG. 2 was prepared. The sub tank 202 had the structure in which a thermoplastic resin housing was bonded to a recording element substrate equipped with a recording head 203 for ejecting an ink by application of thermal energy. The tube (ink supply tube 104) connecting the main tank 201 and the sub tank 202 had a length of 700 mm. The first valve 206 and the second valve 207 were activated in an interlocking manner to block the ink supply tube 104 and the gas inlet tube 204, and then each of the prepared inks was injected from the main tank 201 to fill the ink supply system with the ink.

In the present example, the recording duty of a solid image recorded under conditions where two ink droplets each having a mass of 5 ng were applied to a unit region of 1/600 inch×1/600 inch was defined as 100%. On the whole area of a PPC paper sheet with an A4 size (trade name "GF-500", manufactured by Canon), ten solid images were recorded at a recording duty of 5%, then the recording was suspended for 1 hour, and a nozzle check pattern was recorded. This cycle was repeated. After recording of a predetermined number of solid images, a nozzle check pattern was visually observed, and the ejection stability was evaluated based on the following criteria.

AA: After recording of 4,000 solid images, a nozzle check pattern slightly deteriorated.

A: After recording of 2,000 solid images, a nozzle check pattern slightly deteriorated.

B: After recording of 1,000 solid images, a nozzle check pattern slightly deteriorated.

C: After recording of 500 solid images, a nozzle check pattern markedly deteriorated.

In the evaluation, the time after the start of evaluation was lengthened by increasing the number of recorded paper sheets. This lengthens the contact time of a tube and air and makes the amount of air infiltrating into a tube be likely to increase. The ink state in a tube at the time when a nozzle check pattern deteriorated after recording of a predetermined number of images was visually observed, and then it was found that fine bubbles were generated in the tube. A larger accumulated number of recorded images until a nozzle check pattern deteriorates means that the deterioration of the ejection stability caused by bubbles in a tube is suppressed. Meanwhile, a deterioration of a nozzle check patter means that bubbles generated in a tube move into the ink flow path of the recording head to impair normal ejection of an ink.

Creep Resistance

A tube compressed at a compressibility of 60% was allowed to stand in an environment at a temperature of 60° C. and a relative humidity of 90% for 48 hours. A compressibility of 60% means that a tube having a wall thickness of 10 mm is compressed so as to have a wall thickness of 6 mm and is fixed. After being allowed to stand, the tube was cut at a compressed position and an uncompressed position. The cross section shape of each cut position was visually observed, and the creep resistance of the tube was evaluated based on the following criteria.

AA: A compressed position and an uncompressed position had substantially the same cross section shape.

A: A compressed position was slightly crept as compared with an uncompressed position.

B: A compressed position was half crept as compared with an uncompressed position.

C: A compressed position remained crept.

TABLE 3

Evaluation conditions and evaluation results

| | | Evaluation conditions | | Evaluation results | |
|---|---|---|---|---|---|
| | | Ink | Tube | Ejection stability | Creep resistance |
| Example | 1 | 1 | 5 | AA | AA |
| | 2 | 2 | 5 | AA | AA |
| | 3 | 3 | 5 | AA | AA |
| | 4 | 4 | 5 | AA | AA |
| | 5 | 5 | 5 | AA | AA |
| | 6 | 6 | 5 | AA | AA |
| | 7 | 7 | 5 | AA | AA |
| | 8 | 8 | 5 | AA | AA |
| | 9 | 9 | 5 | AA | AA |
| | 10 | 10 | 5 | AA | AA |
| | 11 | 11 | 5 | AA | AA |
| | 12 | 2 | 2 | AA | B |
| | 13 | 2 | 3 | AA | A |
| | 14 | 2 | 4 | AA | AA |
| | 15 | 2 | 6 | AA | AA |
| | 16 | 2 | 7 | A | AA |
| | 17 | 2 | 8 | B | AA |
| | 18 | 12 | 5 | A | AA |
| | 19 | 13 | 5 | A | AA |
| | 20 | 14 | 5 | A | AA |
| | 21 | 15 | 5 | A | AA |
| | 22 | 16 | 5 | AA | AA |
| | 23 | 17 | 5 | AA | AA |

TABLE 3-continued

| Evaluation conditions and evaluation results | | | | | |
|---|---|---|---|---|---|
| | | Evaluation conditions | | Evaluation results | |
| | | Ink | Tube | Ejection stability | Creep resistance |
| | 24 | 18 | 5 | A | AA |
| | 25 | 14 | 2 | A | B |
| | 26 | 14 | 8 | B | AA |
| Comparative Example | 1 | 19 | 5 | C | AA |
| | 2 | 20 | 5 | C | AA |
| | 3 | 2 | 1 | AA | C |
| | 4 | 2 | 9 | C | AA |

The ejection stabilities of Examples 1, 2, and 6 were comparatively excellent as compared with the ejection stabilities of Examples 3 to 5. Of Examples 1, 2, and 6, Example 2 had particularly excellent ejection stability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213657, filed Oct. 30, 2015, which is hereby incorporated by reference herein in its entirety.

What is claimed is:

1. An ink jet recording method using an ink jet recording apparatus having a first ink storage portion, a second ink storage portion, a tube that supplies an aqueous ink from the first ink storage portion to the second ink storage portion, a mechanism that blocks the tube, and a recording head communicating with the second ink storage portion, the method comprising ejecting the aqueous ink from the recording head to record an image on a recording medium, wherein the tube has an aeration amount (μL/day) of 10 μL/day or more to 60 μL/day or less at a temperature of 40° C., and wherein the aqueous ink comprises a coloring material and a first water-soluble organic solvent having a dielectric constant of 34.0 or less at a temperature of 25° C.

2. The ink jet recording method according to claim 1, wherein the tube has an aeration amount (μL/day) of 20 μL/day or more to 40 μL/day or less at a temperature of 40° C.

3. The ink jet recording method according to claim 1, wherein the tube has an aeration amount (μL/day) of 24 μL/day or more to 36 μL/day or less at a temperature of 40° C.

4. The ink jet recording method according to claim 1, wherein the aqueous ink comprises a second water-soluble organic solvent having a dielectric constant of 27.0 or less at a temperature of 25° C., and wherein a content (% by mass) of the second water-soluble organic solvent is 8.5% by mass or more to 14.5% by mass or less based on a total mass of the ink.

5. The ink jet recording method according to claim 1, wherein the tube is blocked when the aqueous ink is injected into the first ink storage portion.

6. An ink jet recording apparatus for use in the ink jet recording method according to claim 1, the apparatus comprising:

a first ink storage portion;

a second ink storage portion;

a tube that supplies an aqueous ink from the first ink storage portion to the second ink storage portion;

a mechanism that blocks the tube; and a recording head communicating with the second ink storage portion, wherein the tube has an aeration amount (μL/day) of 10 μL/day or more to 60 μL/day or less at a temperature of 40° C., and wherein the aqueous ink comprises a coloring material and a first water-soluble organic solvent having a dielectric constant of 34.0 or less at a temperature of 25° C.

* * * * *